US008037731B2

(12) United States Patent
Yabuki et al.

(10) Patent No.: US 8,037,731 B2
(45) Date of Patent: Oct. 18, 2011

(54) FORGING METHOD AND FORGING APPARATUS

(75) Inventors: Tetsurou Yabuki, Handa (JP); Hideyuki Sato, Obu (JP); Hiroyuki Fujii, Chiryu (JP)

(73) Assignee: Denso Corporation, Kariya (JP)

( * ) Notice: Subject to any disclaimer, the term of this patent is extended or adjusted under 35 U.S.C. 154(b) by 1027 days.

(21) Appl. No.: 11/905,265

(22) Filed: Sep. 28, 2007

(65) Prior Publication Data

US 2008/0083256 A1 Apr. 10, 2008

(30) Foreign Application Priority Data

Oct. 4, 2006 (JP) ..... 2006-273089

(51) Int. Cl.
*B21D 22/00* (2006.01)
*B21J 13/00* (2006.01)

(52) U.S. Cl. ..... 72/352; 72/355.6

(58) Field of Classification Search ..... 72/352, 72/353.2, 354.2, 355.2, 355.6, 356, 359
See application file for complete search history.

(56) References Cited

U.S. PATENT DOCUMENTS 6,151,777 A * 11/2000 Sakuraba ..... 72/356
7,013,696 B2 * 3/2006 Ando et al. ..... 72/355.6
7,191,633 B1 * 3/2007 Uehara et al. ..... 72/355.6

FOREIGN PATENT DOCUMENTS

JP A-11-285774 10/1999
JP A-2004-114134 4/2004
JP A-2004-344931 12/2004
JP 2005-074461 A 3/2005
JP A-2005-153017 6/2005
JP A-2006-043770 2/2006

OTHER PUBLICATIONS

Japanese Office Action mailed Apr. 12, 2011 in Japanese Application No. 2006-273089 with English-language translation.

* cited by examiner

*Primary Examiner* — Teresa Ekiert
(74) *Attorney, Agent, or Firm* — Oliff & Berridge, PLC

(57) ABSTRACT

A forging method and forging apparatus able to improve a dimensional precision of a forged article and able to reduce the machining processes to a minimum and thereby reduce costs are provided. That is, a forging method placing a workpiece inside of a die, pressing the workpiece by a top part of the die in the axial direction toward the bottom part side of the die, and making the material of the end face of the workpiece flow to form the end face of the workpiece into a recessed/projecting shape, which forging method characterized by using independent pressing and holding means for pressing and holding the workpiece in the axial direction independent for the top part and the bottom part at the time of the press forming.

6 Claims, 6 Drawing Sheets

X-VIEW

Y-VIEW (PRIOR ART)

FORGING METHOD AND FORGING APPARATUS

BACKGROUND OF THE INVENTION

1. Field of the Invention

The present invention relates to a forging method and forging apparatus enabling improvement of the precision of a forged article and reduction of the cost of production.

2. Description of the Related Art

In the past, the method of shaping a forging use material which imparts pressing force to a material made of a metal so as forge the material into a predetermined shape has been known.

Further, in the general forging method, obtaining a forged article of the desired dimensional precision is difficult, so the forged shaped article is finished by machining it in a separate process to give it a desired dimensional precision. When performing this additional machining to secure the desired dimensional precision, there is the problem of that the machining increases the number of production processes.

To solve this problem, there is the technique of ironing the outer circumferential portions of a workpiece to improve the dimensional precision of the outer circumferential portions (see Japanese Patent Publication (A) No. 2004-3449311). However, when making the material of the end face of the workpiece flow to forge it into recessed/projecting shapes, in particular when forming a groove shape not point symmetric with the end face of the workpiece (hereinafter referred to as a "non-point symmetric shape") (see FIG. 3), the thickness becomes uneven, so it becomes hard to make the internal stress at the different positions inside the material of the workpiece uniform. In this case, underfill and other defects occur. Further, the walls of the groove are not formed vertical, but end up being formed at a slant, so there were also the problems that the desired precision could not be secured and the required performance could not be satisfied without machining.

This problem will be explained in detail. FIGS. 3A to 3C are views showing a shaped article obtained by shaping a workpiece, wherein FIG. 3A is a view of the shaped article as seen from the X-direction, FIG. 3B is a cross-sectional view of a shaped article, and FIG. 3C is a view of the shaped article as seen from the Y-direction. FIG. 4 is an enlarged cross-sectional view of a groove part of a shaped article. FIG. 6 is a view showing the precision of a groove part of a shaped article forged by a conventional forging method based on actual measurement data. FIG. 8 is a view of the appearance of a workpiece worked by a conventional method. FIG. 9 is a view for explaining the conventional forging method and a view in the state in the middle of plastic deformation of the workpiece.

As shown in FIGS. 3A to 3C, the shaped article 90 is for example an automobile brake part and forms a substantially columnar shape overall. It has a groove 93 and outside wall part 91 having a "non-point symmetric shape" with respect to the axial center Z of the column. That is, the substantially circular shaped curves of the groove walls 93*a* and 93*c* form "non-point symmetric shapes", so do not overlap with the original substantially circular shaped curves when rotated halfway about the axial center Z of the column. That is, the center of the substantially circular shaped curve of the groove wall 93*a* or 93*c* is offset from the axial center Z of the column. By the formation of the groove 93, an elliptical island part 94 is formed at the center, while an embankment shaped outside wall part 91 is formed at its outer circumference. The outside wall part 91 has a wide part (thick part) 91*a* and narrow part (thin part) 91*b*.

On the other hand, in FIG. 9, 50 shows a conventional shaping apparatus. 51 indicates a top punch forming the die top part, 52 indicates a bottom punch forming the die bottom part, 3 indicates a die, W indicates a workpiece before forging (end face of workpiece before forging shown by one-dot chain line), W1 indicates the workpiece in the state in the middle of the forging (shown by solid line), and C indicates a die cavity for forming recessed/projecting shapes at the end face of the workpiece W. Note that the top punch 51 and bottom punch 52 are substantially identical members, while the cavities C of the top punch 51 and the bottom punch 52 are shaped the same.

The top punch 51 and bottom punch 52 are assembled slidable with respect to the die 3. The bottom punch 52 and die 3 are fastened to the body of the forging apparatus (not shown) and will not move. When a workpiece W is set on the bottom punch 52, the top punch 51 is inserted into the center hole 3*a* of the die 3 and set right above the workpiece W. Next, the top punch 51 presses the workpiece W by a drive apparatus (not shown) by a load P0 to move it downward in the axial direction. The top punch 51 moves downward to a predetermined position, then rises. In this way, the shape of the bottom end face of the top punch 51 (including cavity C) is transferred to the top end face of the workpiece W.

When the top punch 51 starts to press the workpiece W, the material of the two end faces of the workpiece W is plastically deformed by the pressing forces of the projection 51*a* of the top punch 51 and the projection 52*a* of the bottom punch 52 and flows into the cavity C. At this time, the shape of the workpiece W is expressed by W1. Note that the width of the projection 51*ax* of the top punch 51 is wider than the width of the projection 51*ay*, while the width of the cavity C2 part is wider than the width of the C3 part.

As shown in FIG. 9, the amount of flow of the workpiece W into the wide width cavity part C2 is large, while the amount of flow of the workpiece W into the narrow width cavity part C3 is small. This is due to the facts that the resistance to the flow of the material to the wide width cavity part C2 is smaller than C3 and that the width of the projection 51*ax* is wide, so there are many parts of the workpiece material receiving the pressing load. Further, the portion of the workpiece abutting against the projection 51*ax* becomes high in internal stress. For this reason, at the narrow width cavity part C3, the workpiece material does not fill the inside of the cavity and underfill, where part of the portion corresponding to the workpiece after forging is missing, easily occurs.

As shown in FIG. 8, it is learned that in a shaped article obtained by a conventional forging method, the arrow part becomes too thin. Further, the wall 93*ay* at the island part 94 side corresponding to the narrow groove part 93 is not formed vertically but is formed at a slant. According to experiments, in a shaped article of a diameter of 40 mm, a height of 30 mm, and a groove depth of 5 mm, the maximum amount of slant relating to the wall 93*ay* was about 100 μm (see FIG. 6). Note that the required target value of this maximum amount of slant is within 50 μm. In a shaped article made by the conventional method, the required target value was not achieved.

On the other hand, FIG. 4 is an enlarged cross-sectional view of a groove part 93 of a shaped article 90. Further, FIG. 6 is a view expressing the precision of a shaped article forged by a conventional method based on actually measured data. FIG. 4 is a view for explaining the definitions of the abscissa x and ordinate y of FIG. 6 (and later explained FIG. 5). In FIG. 4, s is the reference point, and t is the measurement position.

Further, x indicates the distance from the reference point s at the measurement position t, while y indicates the amount of slant of the groove wall 93*a* from the reference point s at the measurement position t. As shown in FIG. 6, the maximum amount of slant of the groove wall of the location B corresponding to the thin part 91*b* (see FIG. 3(*a*)) was, by actual measurement value, about 100 μm, while the maximum amount of slant of the groove wall of the location A corresponding to the thin part 91*a* was about 60 μm. It will be understood that the location A and location B greatly differ in amount of slant of the groove wall. Note that the target value of the maximum amount of slant of the groove wall is 50 μm.

SUMMARY OF THE INVENTION

The present invention was made in consideration of the above problem and has as its object the provision of a forging method able to improve the dimensional precision of a forged article and to sharply reduce the machining processes and thereby reduce the costs. In particular, it has as its object the provision of a forging method making the material of the end face of the workpiece flow to shape it into into recessed/projecting shapes, which forging method is free from accompanying underfill and other defects, improves the dimensional precision of the forged article, and sharply reduces the machining processes and reduces the cost, and a forging apparatus for the same.

The present invention provides the following aspects of a forging method and forging apparatus as means for solving the above problems. According to a first aspect of the present invention, the forging method or forging apparatus is characterized by, at the time of press forming, applying to the end face of the workpiece by the top part a first external force pressing it in the axial direction toward the bottom part side and applying a second external force independent from the first external force to press and hold the workpiece end face and thereby form the workpiece end face into recessed/projecting shapes.

Due to this, in particular when forming not point symmetric recessed/projecting shapes at the workpiece end face, by applying a second external force independent from the first external force, the internal stress at the workpiece end face is equalized and plastic flow free of bias can be caused inside the die cavity. That is, the plastically flowing workpiece material is filled into each corner of the die cavity with more uniform internal stress than the past and with uniform fluidity as well. In this way, it becomes possible to eliminate underfill and other defects and improve the dimensional precision of a forged article and becomes possible to greatly reduce the machining processes of the workpiece.

According to a second aspect of the present invention, the forging method or forging apparatus is characterized in that at the time of press forming, the top part and bottom part use independent pressing and holding means independently pressing and holding the workpiece in the axial direction. Due to this, a specific means for generating a second external force is provided.

According to a third aspect of the present invention, the forging method or forging apparatus is characterized in that the second external force is a pressing and holding force by the independent pressing and holding means. This shows a specific aspect of the second external force.

According to a fourth aspect of the present invention, the forging method or forging apparatus is characterized by using a plurality of independent pressing and holding means to mutually independently generate pressing and holding forces by a plurality of independent pressing and holding means. Due to this, the plastic flow of the workpiece material can be controlled extremely finely at the time of forging and the dimensional precision of the forged article can be improved more.

BRIEF DESCRIPTION OF THE DRAWINGS

These and other objects and features of the present invention will become clearer from the following description of the preferred embodiments given with reference to the attached drawings, wherein:

FIG. 2 is an enlarged cross-sectional view of the top punch of FIG. 1, FIGS. 3A to 3C are views showing a forged article obtained by forging a workpiece, wherein

DESCRIPTION OF THE PREFERRED EMBODIMENTS

Figure 1:
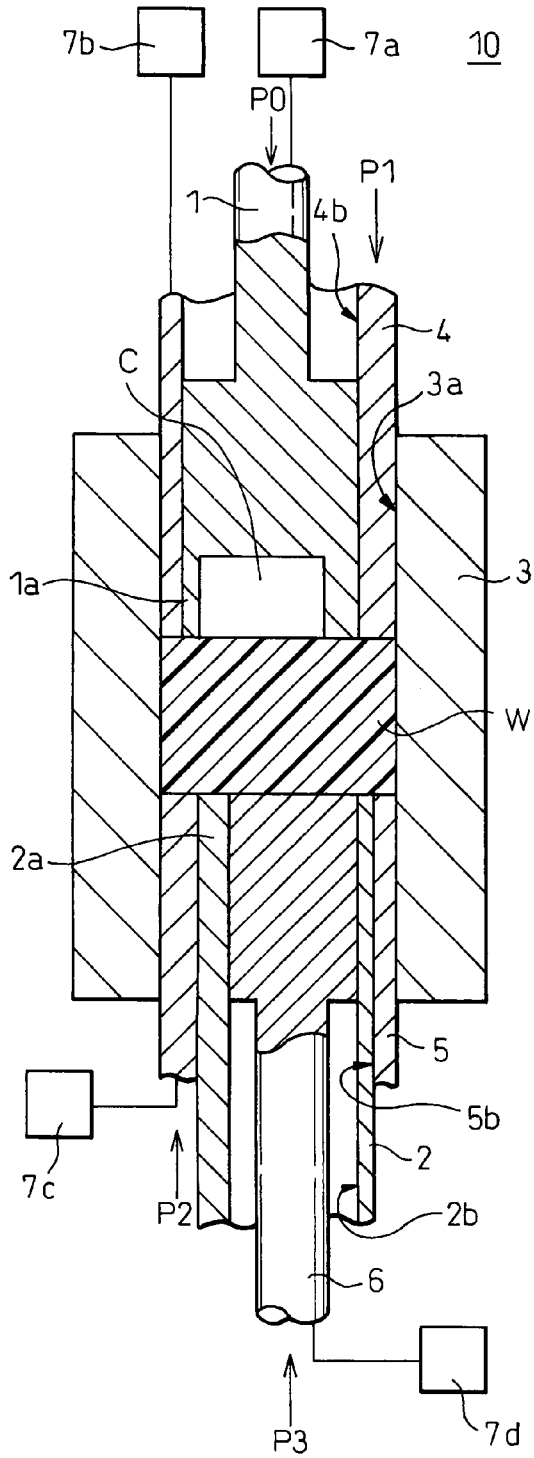
FIG. 1 is a view for explaining the forging method and forging apparatus according to the present invention.
Figure 2:
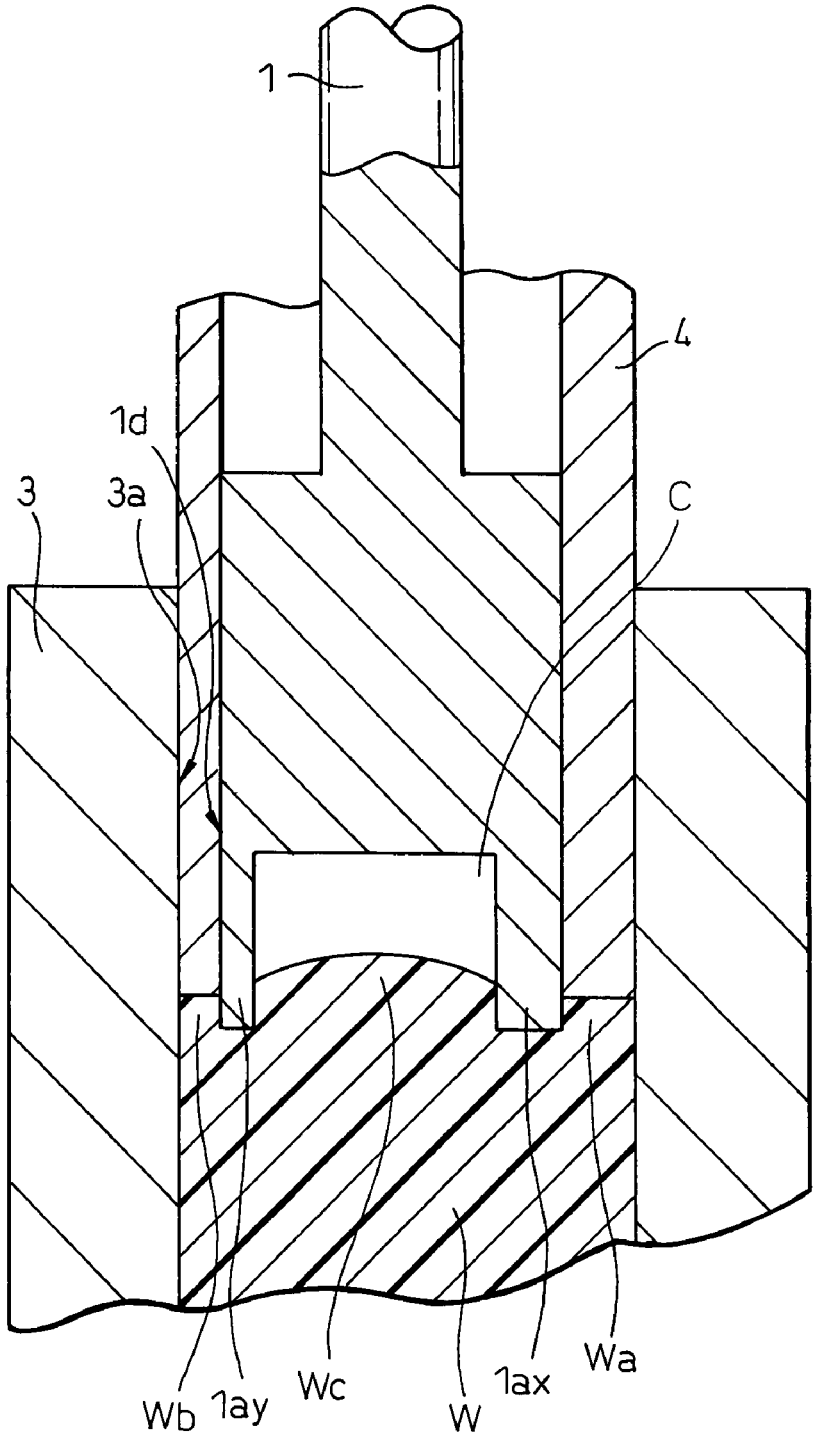
Figure 5:
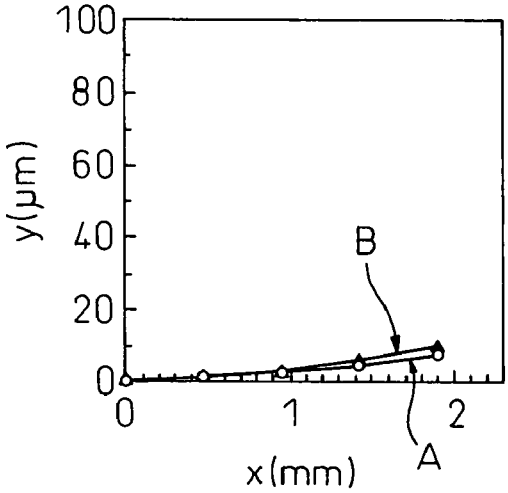
FIG. 5 is a view showing the precision of a forged article obtained by the method according to the present invention by actual measurement values.
Figure 7:
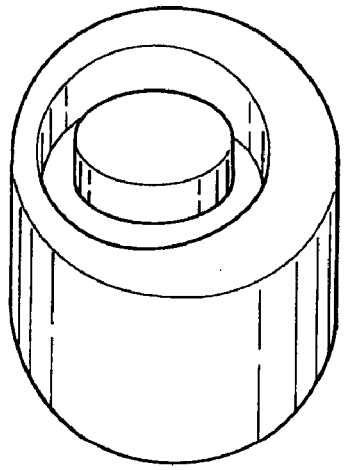
FIG. 7 is a view of the appearance of a forged article obtained by the method according to the present invention.
Figure 8:
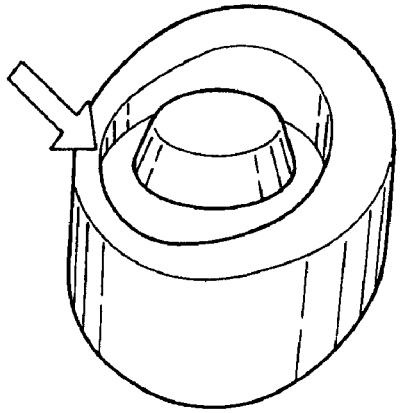
Fig.8 (PRIOR ART)
FIG. 8 is a view of the appearance of a forged article obtained by a conventional method.
Figure 9:
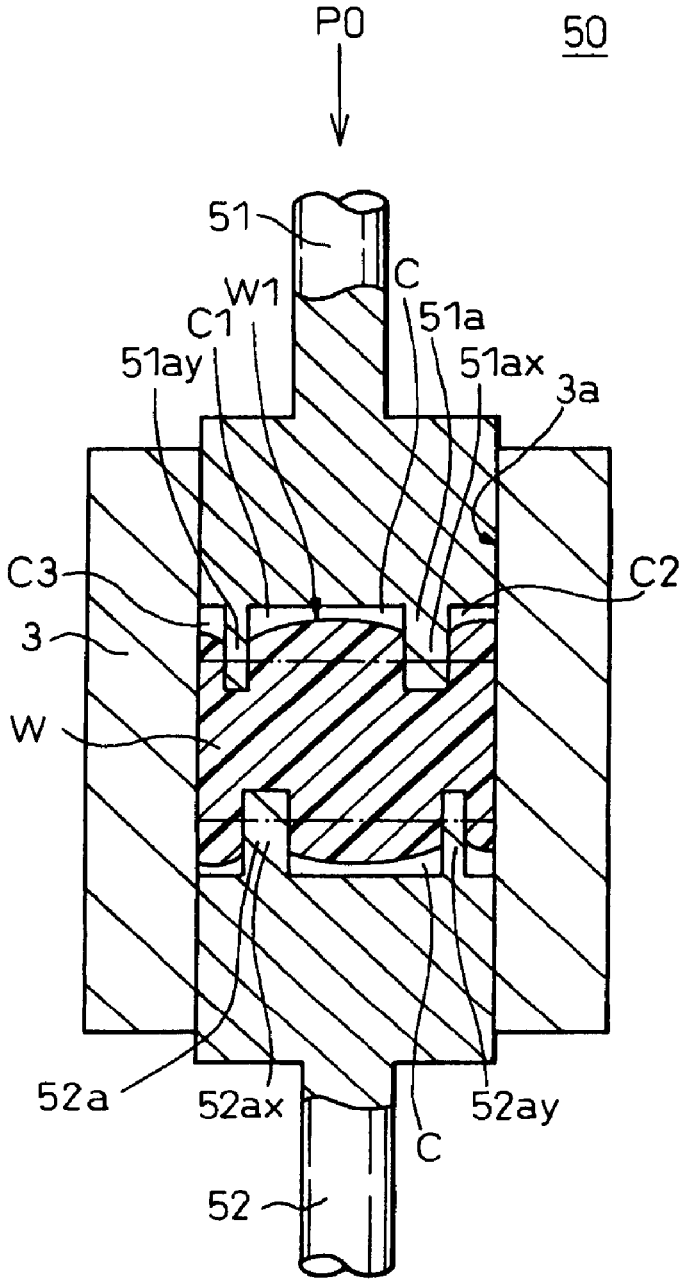
FIG. 9 is a view for explaining a conventional forging method.

Below, embodiments of the present invention will be explained based on the drawings. FIG. 1 is a view for explaining the forging method and forging apparatus according to the present invention. FIG. 2 is an enlarged cross-sectional view of a top punch of FIG. 1. FIG. 5 is a view showing the precision of a groove of a shaped article forged by a forging method and forging apparatus according to the present invention using actual measurement values. FIG. 7 is a view of the appearance of a workpiece worked by the forging method and forging apparatus according to the present invention.

First, the forging apparatus according to the present invention will be explained. In FIG. 1, 10 shows the forging apparatus according to the present invention. 1 shows a top punch forming a die top part, 2 shows a bottom punch forming a die bottom part, 3 shows a die, W shows a columnar workpiece, and C shows a die cavity. Reference numeral 4 is a first pressing and holding means independent from the top punch 1, 5 is a second pressing and holding means independent from the bottom punch 2, and 6 is a third pressing and holding means independent from the bottom punch 2.

The die 3 has a substantially cylindrical, high rigidity structure and has a cylindrical hole 3*a* in which the workpiece W is set at the center. Inside this cylindrical hole 3*a*, at the top side, the cylindrical first pressing and holding means 4 is slidably inserted, at the middle, the workpiece W is set, and at the bottom, the second pressing and holding means 5 is slidably inserted. The clearances between the cylindrical hole 3*a*, first pressing and holding means 4, workpiece W, and second pressing and holding means 5 become close enough to zero not enough to prevent mutual sliding.

Further, at the center of the first pressing and holding means 4, a hole 4*b* is formed. The top punch 1 is slidably inserted in this and is set right above the workpiece W. Further, at the center of the second pressing and holding means 5 as well, a hole 5*b* is formed. The bottom punch 2 is slidably inserted into this. At the center of the bottom punch 2, a hole 2*b* is formed. The third pressing and holding means 6 is slidably inserted into this. The shaping projection 1*a* of the top punch 1 and the shaping projection 2*a* of the bottom punch 2 are shaped the same. Note that shaping projection 1*a* is approximately cylindrical in shape. The center of this approximate cylindrical shape is offset from the axial center of the punch 1. Further, the shaping projection 1*a* is formed so as to stick out in the axial direction of the punch 1. The width is formed narrow at one side and wide at another.

The top punch 1, first pressing and holding means 4, second pressing and holding means 5, and third pressing and holding means 6 have mutually independent corresponding driving means 7*a* to 7*d* connected to them. These are respectively called the top punch driving means 7*a*, first driving means 7*b*, second driving means 7*c*, and third driving means 7*d*. These driving means are for example driven by hydraulic motors.

The bottom punch 2 and die 3 are fastened to the body of the forging apparatus and will not displace. The center of the bottom punch 2 and the center of the top punch 1 are fastened shifted in position. Further, the end faces of the bottom punch 2 and second pressing and holding means 5 and third pressing and holding means 6 are set on the same plane. In this state, when the workpiece W is set on the end face of the bottom punch 2 and second pressing and holding means 5 and third pressing and holding means 6, the top punch 1 and the first pressing and holding means 4 are inserted into the center hole 3*a* of the die 3 and is set right above the workpiece W.

Next, the forging method using the forging apparatus according to the present invention and the action and effects of the same will be explained. When the top punch driving means 7*a* and first driving means 7*b* are supplied with voltage, the top punch driving means 7*a* and first driving means 7*b* displace downward along the axial direction and, as shown in FIG. 1, the bottom surfaces of the top punch 1 and first pressing and holding means 4 abut against the top surface of the workpiece W. From this abutment time (hereinafter referred to as the "top punch abutment time"), the top punch 1 is subjected to a pressure of for example P0=1000 MPa through the top punch driving means 7*a*, while the first pressing and holding means 4 is subjected to a pressure of for example P1=300 MPa through the first driving means 7*b*. The first pressing and holding means 4 maintains the position in the vertical direction and presses and holds the end face of the workpiece W when the pressing force reaches 300 MPa.

Next, as shown in FIG. 2, the driving means 7*a* of the top punch 1 causes the top punch 1 to displace further downward from the workpiece end face, whereby the projections 1*ax*, 1*ay* of the top punch 1 are pressed into the workpiece W and the material of the outer circumference side of the end face of the workpiece W flows into the space formed between the inner circumferential surface 3*a* of the die 3 and the outer circumferential surface 1*d* of the top punch 1 (portion shown by Wa and Wb). At this time, the material at the outer circumference side of the end face of the workpiece W is constantly pressed and held by the first pressing and holding means 4 to which a 300 MPa pressure is applied. For this reason, due to pressure P1 applied from the outside, that is, from the first driving means 7*b* independent of the driving means 7*a* of the top punch, the pressure inside the workpiece at the parts right below the projections 1*ax*, 1*ay* of the top punch 1 is equalized and the material at the outer circumference (Wa and Wb parts) flows inside the space evenly without bias. That is, the different portions of the material at the outer circumference are subjected to an approximately 300 MPa uniform internal stress. In this way, the space is filled with the flowing material of the workpiece W.

Further, when the projections 1*ax*, lay of the top punch 1 are pressed inside the workpiece W, simultaneously the material of the portion of the end face of the workpiece W abutting against the top punch 1 also flows into the cavity C of the top punch 1. At this time, the pressure P1 applied from the outside by the first pressing and holding means 4 causes the pressures inside the workpiece at the parts right under the projections 1*ax*, 1*ay* of the top punch 1 to become uniform, so the material of the workpiece at the parts right under the projections 1*ax*, 1*ay* also flows inside the space C evenly without bias.

On the other hand, starting from the top punch abutment time, the second pressing and holding means 5, like the first holding means 4, receives a pressure of for example P2=100 MPa through the second driving means 7*c* and presses and holds the bottom end face of the workpiece W. Further, the third pressing and holding means 6 receives for example P3=200 MPa through the third driving means 7*d* and, like the second pressing and holding means 5, presses and holds the bottom end face of the workpiece W. In this state, when the bottom punch 2 is pressed inside the workpiece W, the material of the portion of the end face of the workpiece W abutting against the bottom punch 2 flows to the surroundings. At this time, the pressure P2 applied by the second pressing and holding means 5 from the outside and the pressure P3 applied by the third pressing and holding means 6 from the outside cause the pressure inside the workpiece at the part right below where the bottom punch 2 abuts against the workpiece W to be equalized, so the material of the workpiece also flows evenly without bias. Further, the pressing and holding forces applied to the first, second, and third pressing and holding means 4, 5, and 6 in principle are made smaller than the pressing forces applied to the punches 1 and 2. This is because the holding pressure need only be one required for holding the material flowing when the pressing forces of the punches 1, 2 cause the workpiece W to deform.

Figure 3A:
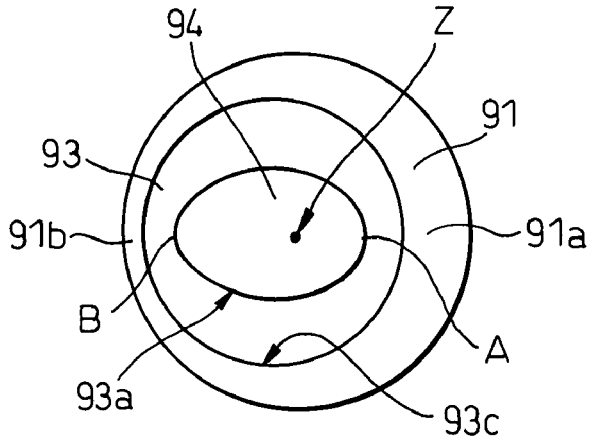
FIG. 3A is a view of the shaped article as seen from the X-direction.
Figure 3B:
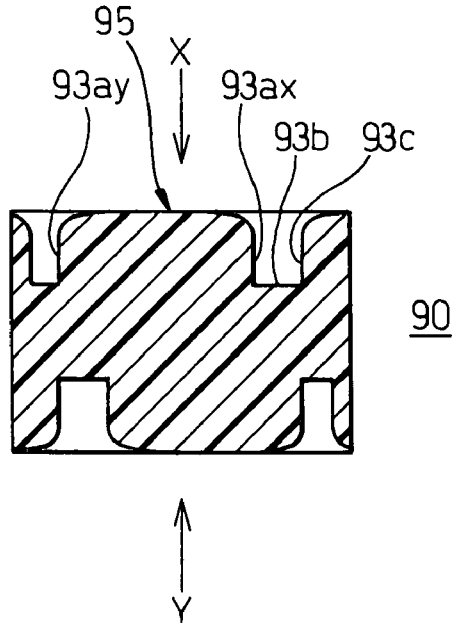
FIG. 3B is a cross-sectional view of a shaped article.
Figure 3C:
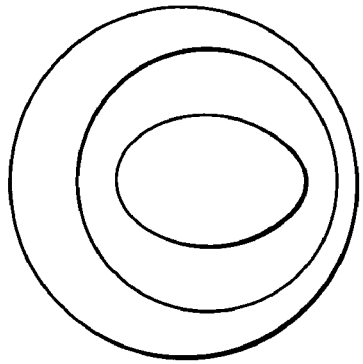
FIG. 3C is a shaped article as seen from the Y-direction.

When the top punch 1 and bottom punch 2 move to predetermined depths and a predetermined shape is formed, the top punch driving means 7*a* and the bottom punch driving means 7*d* stop the movements of the two punches. Next, the top punch driving means 7*a* and the first driving means 7*b* cause the top punch 1 and the first pressing and holding means to displace upward. The top punch 1 and first pressing and holding means 4 are separated from the workpiece W, then the third pressing and holding means 6 is displaced upward and the shaped workpiece W is taken out from the die 3. That is, the third pressing and holding means 6 is also a means for pressing the shaped article. FIG. 3 was used for explaining a conventional forged article, but also shows a shaped article forged using the forging method and forging apparatus according to the present invention. The general shape is similar to a conventional forged article, so the explanation will be omitted.

Figure 4:
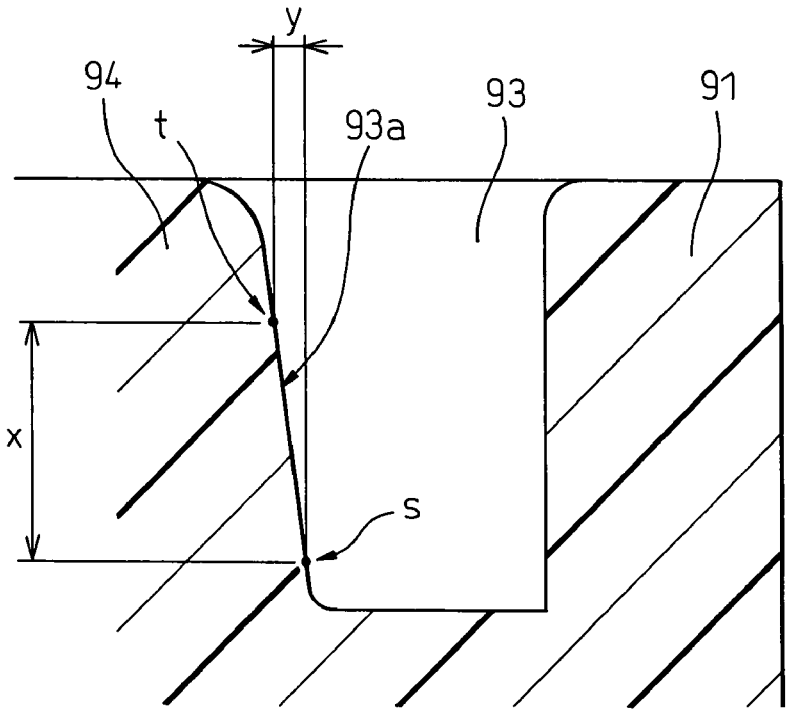
FIG. 4 is an enlarged cross-sectional view of a groove part of FIG. 3.
Figure 6:
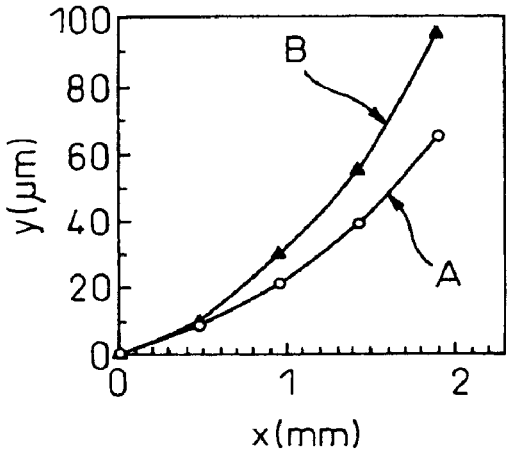
Fig.6 (PRIOR ART)
FIG. 6 is a view showing the precision of a forged article obtained by the conventional method by actual measurement values.

FIG. 5 shows the precision of a groove of a forged article in FIG. 3 shaped by the method according to the present invention (hereinafter referred to as the "invention shaped article") by actual measurement values. The abscissa x and ordinate y of FIG. 5 are similar to the numerical values explained with reference to FIG. 4 in FIG. 6 That is, FIG. 4 is a view for explaining the definitions of the abscissa x and ordinate y of FIG. 5. In FIG. 4, s indicates the reference point, while t indicates the measurement position. Further, x shows the distance from the reference point s at the measurement position t, while y shows the amount of slant of the groove wall 93*a* from the reference point s at the measurement position. As shown in FIG. 5, maximum bending amount y is about 10 μm at the point B. This is greatly reduced compared with the maximum bending amount of about 100 μm of a forged article of the prior art. The target value of the maximum bending amount is, with both the point A and point B, 50 μm or less, so falls within the target value. Further, the difference between the point A and point B regarding the maximum bending amount of the invention shaped article disappears almost entirely. In this way, the shaped article of the invention achieves a good precision. There is no need to machine the groove wall 93*a*. Note that machining the groove wall 93*a* of a shaped article by the conventional method takes an extremely long time. Quality control also was not easy.

In the above way, the workpiece W is shaped by the top part and bottom part of the die while being pressed and held by the plurality of pressing and holding means, so forging of a shaped article with no underfill and with a high precision becomes possible. For this reason, the separate steps of machining after forging the workpiece W and the machine tools for the same are no longer necessary, so the capital costs can be cut and the production process can be shortened.

Further, the above apparatus was configured provided with a punch and pressing and holding means so as to form recessed/projecting shapes at the two end faces of the workpiece W, but a similar effect arises even if forming the recessed/projecting shapes just at the top punch side. In this case, a forging apparatus forging an eccentric ring-shaped recess and a projection inside the recess at only the top surface of the cylindrical workpiece W is used and has the following configuration: That is, this forging apparatus is provided with a top punch 1 forming the top part of the die, a lower holding means forming the bottom part of the die, a cylindrical die 3, and a first pressing and holding means 4. Further, the workpiece W is set between the top punch 1 and the lower holding means, the top punch 1 facing the workpiece W is formed with a cavity C forming the projection and a shaping projection 1*a* forming the recess around the cavity C. The first pressing and holding means 4 is arranged around the top punch 1 independent from the top punch 1 and is formed with a hole 4*b* at its center. The cylindrical die 3 has a hole 3*a* in which the workpiece W is set at its center. The hole 3*a* has the first pressing and holding means 4 slidably inserted into it from the top side, the hole 4*b* of the first pressing and holding means 4 has the top punch 1 slidably inserted into it, and the lower holding means is fastened at the bottom side of the hole 3*a* of the die 3. The shaping projection 1*a* is cylindrical in shape and is formed so as to stick out in the axial direction of the punch 1. Further, the width of the shaping projection 1*a* is narrow at one side and wide at the other. The lower holding means and the die 3 are fastened so as not to displace from the body of the forging apparatus.

According to the above configuration, when the workpiece W is set over the end face of the lower holding means, the top punch 1 and the first pressing and holding means 4 are inserted into the hole 3*a* of the die 3 and set right above the workpiece W. At this time, the bottom surfaces of the top punch 1 and the first pressing and holding means 4 abut against the top surface of the workpiece W. From this abutment time, that is, top punch abutment time, the top punch 1 is given for example a P0=1000 MPa basic pressure and the first pressing and holding means 4 is given for example a first pressure of P1=300 MPa smaller than the basic pressure. The first pressing and holding means 4 maintains its position in the vertical direction and presses and holds the end face of the workpiece W when the pressing force reaches the first pressure P1 (300 MPa). Due to the displacement of the top punch 1 further below the workpiece end face, the shaping projection 1*a* of the top punch 1 is pressed inside the workpiece W. The material at the outer circumference side of the workpiece W end face flows to the spaces Wa and Wb formed between the inner circumference of the die 3 and the outer circumference of the top punch 1. At this time, the material at the outer circumference side of the workpiece W end face is pressed and held by the first pressing and holding means 4 to which the pressure of the first pressure P1 (300 MPa) is applied. For this reason, the first pressure P1 (300 MPa) causes the pressure inside the workpiece at the part right below the shaping projection 1*a* of the top punch 1 to become uniform and the material at the outer circumference side of the spaces Wa and Wb to flow into the spaces evenly without bias. That is, the different parts of the material at the outer circumference side are subjected to uniform internal stress of about 300 MPa due to the first pressure P1. In this way, the spaces are filled by the flowing material of the workpiece W. Further, when the shaping projection 1*a* of the top punch 1 is pressed into the workpiece W, simultaneously the material of the end face of the workpiece W portion abutting against the top punch 1 flows into the cavity C of the top punch 1. At this time, due to the first pressure P1 applied by the first pressing and holding means 4 from the outside, the pressure inside the workpiece at the part right under the shaping projection 1*a* of the top punch 1 is made even, so the material of the part right under the shaping projection 1*a* also flows into the cavity C evenly without bias. Further, during this time, the lower holding means presses and holds the bottom end face of the workpiece W. When the top punch 1 moves to a predetermined depth and a predetermined shape is formed, the movement of the top punch is stopped. Next, the top punch 1 and the first pressing and holding means 4 are displaced upward, the top punch 1 and first pressing and holding means 4 are separated from the workpiece W, then the shaped workpiece W is taken out from the die 3.

The forging according to the method and apparatus of the present invention may be performed under various conditions regardless of the presence or absence of heating of the forged material, the heating temperature, etc. That is, the method and apparatus of the present invention can be advantageously applied not only to cold forging, but also hot forging. According to the present invention, in particular when forming not point symmetric recessed/projecting shapes at the workpiece end face, by applying a second external force independent from the first external force to the workpiece end face to press and hold the same, the internal stress of the workpiece end face is made even and plastic flow with no bias is caused in the die cavity. That is, the plastically flowing workpiece material is made uniform in fluidity by an internal stress more uniform than the past and filled up to each corner of the die cavity. In this way, it becomes possible to improve the dimensional precision of a forged article without accompanying underfill or other defects and possible to sharply reduce the machining processes of a workpiece.

While the invention has been described with reference to specific embodiments chosen for purpose of illustration, it should be apparent that numerous modifications could be made thereto by those skilled in the art without departing from the basic concept and scope of the invention.

The invention claimed is:

1. A forging method comprising:

setting a workpiece inside a die, pressing the workpiece by a top part of the die in an axial direction toward a bottom part of the die, and making a material of an end face of the workpiece form a top end face of the workpiece into a shape having an eccentric ring-shaped recess and a projection, wherein, at the time of the pressing, a basic pressure is applied to the top end face of the workpiece at a location of the projection to be formed in the top end face of the workpiece by pressing the top part of the die in the axial direction toward the bottom part of the die, and, a first pressing and holding means applies a first pressure, independent from the basic pressure, to press and hold the top end face of the workpiece, surrounding the location of the projection to be formed in the top end face of the workpiece, to form the top end face of the workpiece into the eccentric ring-shaped recess and the projection, and press forming an eccentric ring-shaped recess and a projection in a bottom end face of the workpiece, by a stationary cylindrical bottom part of the die, wherein a second pressing and holding means applies a second pressure to a cylindrical outer circumference of the bottom part of the workpiece, and wherein a third pressing and holding means applies a third pressure to an inside of the cylindrical outer circumference of the bottom part of the workpiece.

2. A forging method as set forth in claim 1, wherein the first pressing and holding means, the second pressing and holding means and the third pressing and holding means press and hold the workpiece in an axial direction independent from the top part of the workpiece and the bottom part of the workpiece at the time of press forming.

3. A forging method as set forth in claim 2, wherein the first pressure is a pressure smaller than the basic pressure, the second pressure is a pressure smaller than the first pressure, and the third pressure is a pressure larger than the second pressure and smaller than the first pressure.

4. A forging method as set forth in claim 3, wherein the basic pressure and the first pressure, the second pressure and the third pressure are generated mutually independently using a plurality of independent driving means.

5. A forging method as set forth in claim 1, wherein a forging apparatus used for the forging method is provided with a top punch for forming the top part of the die, a lower holding means for forming the bottom part of the die, a cylindrical die, and the first pressing and holding means, the workpiece being set between the top punch and the lower holding means, the top punch facing the workpiece being formed with a cavity forming the projection and a shaping projection forming the recess around the cavity, the first pressing and holding means being arranged around the top punch independent from the top punch and is formed with a hole at a center of the first pressing and holding means, the cylindrical die having a hole for setting the workpiece at its center, the hole having the first pressing and holding means slidably inserted into it from a top side of the cylindrical die, the hole of the first pressing and holding means having the top punch slidably inserted into it, and the lower holding means being fastened at a bottom side of the hole of the cylindrical die, the shaping projection being formed into a cylindrical shape projecting out in an axial direction of the top punch, the shaping projection being formed with a narrow width at one end and a wide width at another end, and the lower holding means and the cylindrical die being fastened so as not to displace from a body of the forging apparatus, the forging method further comprising the following:

setting the workpiece on an end face of the lower holding means, inserting the top punch and the first pressing and holding means into the hole of the die and being set above the workpiece, and abutting bottom surfaces of the top punch and the first pressing and holding means against a top surface of the workpiece, applying the basic pressure to the top punch from a time of the abutting, wherein the first pressure smaller than the basic pressure is applied to the first pressing and holding means, and the first pressing and holding means maintains its position in a vertical direction and presses and holds the end face of the workpiece when a pressing force reaches the first pressure, displacing the top punch further downward from the workpiece end face so that the shaping projection of the top punch is pressed inside the workpiece, flowing the material at the outer circumference of the end face of the workpiece into spaces formed between an inner circumference of the cylindrical die and an outer circumference of the top punch, and filling the spaces by the flowing material of the workpiece, and pressing the shaping projection of the top punch inside the workpiece and simultaneously flowing material of the end face of the workpiece abutting against the top punch into the cavity of the top punch and flowing the material of the workpiece at a part below the shaping projection into the cavity.

6. A forging method as set forth in claim 1, wherein a forging apparatus used for the forging method is provided with a top punch for forming the top part of the die, a bottom punch for forming the bottom part of the die and a hole at a center of the bottom punch, a cylindrical die, the first pressing and holding means, the second pressing and holding means, and the third pressing and holding means, the workpiece being set between the top punch and the bottom punch, the top punch being formed with a cavity that forms the projection of the workpiece and a shaping projection that forms the recess of the workpiece around the cavity, the first pressing and holding means being arranged around the top punch independent from the top punch and being formed with a hole at a center of the first pressing and holding means, the second pressing and holding means being arranged around the bottom punch independent from the bottom punch and being formed with a hole at a center of the second pressing and holding means, the third pressing and holding means being arranged inside the bottom punch independent from the bottom punch and forming a projection at a rear surface side of the workpiece, the cylindrical die having a hole for setting the workpiece at its center, the hole having the first pressing and holding means slidably inserted therein from a top side of the cylindrical die and having the second pressing and holding means slidably inserted into the cylindrical die from a bottom side of the cylindrical die, the hole of the first pressing and holding means having the top punch slidably inserted therein, and the hole of the second pressing and holding means having the bottom punch slidably inserted therein, the hole of the bottom punch having the third pressing and holding means slidably inserted therein, the shaping projection being formed into a cylindrical shape projecting out in an axial direction of the punch, the shaping projection being formed with a narrow width at one end and a wide width at another end, and the bottom punch and the cylindrical die being fastened so as not to displace from a body of the forging apparatus, and the bottom punch, the second pressing and holding means and the third pressing and holding means having workpiece side end faces set in a same plane before a pressurization of the cylindrical die, the forging method further comprising:

setting the workpiece on end faces of the bottom punch and the second pressing and holding means and the third pressing and holding means, inserting the top punch and the first pressing and holding means into the hole of the cylindrical die above the workpiece, and abutting bottom surfaces of the top punch and the first pressing and holding means against a top surface of the workpiece, applying the basic pressure to the top punch from a time of the abutting, wherein the first pressure smaller than the basic pressure is applied to the first pressing and holding means, and the first pressing and holding means maintains its position in a vertical direction and presses and holds the end face of the workpiece when a pressing force reaches the first pressure, displacing the top punch further downward from the workpiece end face so that the shaping projection of the top punch is pressed inside the workpiece, flowing material at the outer circumference of the end face of the workpiece into spaces formed between an inner circumference of the cylindrical die and an outer circumference of the top punch, and filling the spaces with the flowing material of the workpiece, pressing the shaping projection of the top punch inside the workpiece and simultaneously abutting the material of the end face of the workpiece against the top punch inside the cavity of the top punch, and applying, from a time of the abutting, the second pressure smaller than the first pressure applied to the second pressing and holding means so as to press and hold the bottom end face of the workpiece and applying a third pressure larger than the second pressure, but smaller than the first pressure to the third pressing and holding means so as to press and hold the top end face of the workpiece and flowing the material of the portion of the end face of the workpiece abutting against the bottom punch into surroundings when the bottom punch is pressed into the workpiece.

* * * * *